US009150038B2

(12) United States Patent
Hashimoto

(10) Patent No.: US 9,150,038 B2
(45) Date of Patent: Oct. 6, 2015

(54) PRINTING DEVICE HAVING SLOW DISCHARGE PROCESS FOR SEQUENTIAL PRINT JOBS

(75) Inventor: Naoki Hashimoto, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 353 days.

(21) Appl. No.: 13/182,818

(22) Filed: Jul. 14, 2011

(65) Prior Publication Data

US 2012/0020716 A1 Jan. 26, 2012

(30) Foreign Application Priority Data

Jul. 26, 2010 (JP) ..... 2010-166721

(51) Int. Cl.

| | |
|---|---|
| ***B41J 11/42*** | (2006.01) |
| ***B41J 13/00*** | (2006.01) |
| *G03G 15/00* | (2006.01) |

(52) U.S. Cl.

CPC ..... *B41J 13/0036* (2013.01); *B41J 13/0009* (2013.01); *G03G 15/6573* (2013.01)

(58) Field of Classification Search

CPC ..... B41J 13/0009; B41J 13/0036; G03G 15/6555

USPC ..... 399/397, 405, 407; 400/582; 271/279

See application file for complete search history.

(56) References Cited

U.S. PATENT DOCUMENTS

| | | | | |
|---|---|---|---|---|
| 5,960,247 | A * | 9/1999 | Morikawa | 399/382 |
| 6,671,472 | B2 * | 12/2003 | Shimizu et al. | 399/82 |
| 7,577,396 | B2 * | 8/2009 | Kitano | 399/405 |
| 2003/0030836 | A1 * | 2/2003 | Maekawa | 358/1.14 |
| 2005/0285334 | A1 | 12/2005 | Sato et al. | |
| 2008/0013127 | A1 * | 1/2008 | Ohkawa et al. | 358/296 |

FOREIGN PATENT DOCUMENTS

| | | | |
|---|---|---|---|
| CN | 1460907 | A | 12/2003 |
| CN | 101618807 | A | 1/2010 |
| EP | 0 931 745 | A2 | 7/1999 |
| JP | HEI 9-272659 | | 10/1997 |
| JP | 10-143021 | A | 5/1998 |
| JP | HEI 11-105383 | | 4/1999 |
| JP | 2001-96877 | | 4/2001 |
| JP | 2001-213025 | | 8/2001 |
| JP | 2002-366316 | | 12/2002 |

(Continued)

OTHER PUBLICATIONS

Machine Translation of Hirakawa et al. (JP 2003320732), published Nov. 11, 2003.*

(Continued)

*Primary Examiner* — Blake A Tankersley
*Assistant Examiner* — Quang X Nguyen
(74) *Attorney, Agent, or Firm* — Scully, Scott, Murphy & Presser P.C.

(57) ABSTRACT

A printing device is provided with a printing unit configured to print an image on a sheet, a sheet discharge unit having a discharge tray and configured to discharge the sheet from the printing unit to the discharge tray, and a control unit configured to control the sheet discharge unit to execute a slow discharge process between two subsequent print jobs, the slow discharge process being a sheet discharge process in which sheet discharging ability of the sheet discharge unit is impaired.

15 Claims, 8 Drawing Sheets

(56) References Cited

FOREIGN PATENT DOCUMENTS

| | | | | |
|---|---|---|---|---|
| JP | 2003-122526 | | | 4/2003 |
| JP | 2003-246102 | | | 9/2003 |
| JP | 2003-266893 | | | 9/2003 |
| JP | 2003-312098 | | | 11/2003 |
| JP | 2003-320732 | A | | 11/2003 |
| JP | 2003312098 | A | * | 11/2003 |
| JP | 2004-59268 | | | 2/2004 |
| JP | 2004-175043 | | | 6/2004 |
| JP | 2004-258257 | A | | 9/2004 |
| JP | 2004-277091 | | | 10/2004 |
| JP | 2005-84307 | | | 3/2005 |
| JP | 2006-16130 | | | 1/2006 |
| JP | 2006-036533 | | | 2/2006 |
| JP | 2006-184713 | | | 7/2006 |
| JP | 2006-213414 | | | 8/2006 |
| JP | 2007-104066 | | | 4/2007 |
| JP | 2008-284722 | | | 11/2008 |

OTHER PUBLICATIONS

Notification of Reasons for Rejection dated Sep. 18, 2012 received from the Japanese Patent Office from related Japanese Application No. 2010-184335 and U.S. Appl. No. 13/072,360, together with an English-language translation.

U.S. Official Action dated Mar. 5, 2013 from related U.S. Appl. No. 13/072,360.

U.S. Notice of Allowance dated May 29, 2013 from related U.S. Appl. No. 13/072,360.

Notification of Reasons for Rejection dated May 14, 2013 from related Japanese application JP 2010-166721 together with English translation.

Extended European Search Report and Search Opinion dated Nov. 24, 2011 from related European Patent Application No. 11159645.8 and U.S. Appl. No. 13/072,360.

Chinese Office Action dated Nov. 21, 2013 from related Chinese Application No. 201110085404.1, together with an English language translation.

* cited by examiner

PRINTING DEVICE HAVING SLOW DISCHARGE PROCESS FOR SEQUENTIAL PRINT JOBS

CROSS-REFERENCE TO RELATED APPLICATION

This application claims priority under 35 U.S.C. §119 from Japanese Patent Application No. 2010-166721 filed on Jul. 26, 2010. The entire subject matter of the application is incorporated herein by reference.

BACKGROUND

1. Technical Field

Aspects of the present invention relate to a printing device which prints images on printing sheets.

2. Related Art

Recently, printing devices such as a printer, a copier, a facsimile machine, etc. have been improved so that a printing speed is significantly increased. In association with the speed-up of the printing operation, it becomes difficult to remove printed sheets collected (stacked) on a discharge tray when a continuous printing operation is performed.

In a conventional device, by switching the sheet discharge trays when the continuous printing operation is performed (i.e., when a plurality of print jobs are continuously executed), the user can remove the printed sheets while the printing operation is kept performed. Alternatively, the continuous printing operation is paused to allow the user to remove the printed sheets.

SUMMARY

When the sheet discharge trays are switched, however, the destinations (i.e., the sheet discharge trays to be used) may be changed when a single print job is being executed, and the printed sheets are discharged to separate trays. Therefore, the user can remove the printed sheets from separate trays, and it becomes necessary for the user to check the order of the sheets and the like. When the printing operation is paused, no printing operation is executed until the subsequent printing operation is executed, which may reduce productivity.

In consideration of the above, aspects of the invention provides an improved printing device with which the reduction of productivity is suppressed, while the user can remove the printed sheets with allowing the continuous printing operation.

According to aspects of the invention, there is provided a printing device which is provided with a printing unit configured to print an image on a sheet, a sheet discharge unit having a discharge tray and configured to discharge the sheet from the printing unit to the discharge tray, and a control unit configured to control the sheet discharge unit to execute a slow discharge process between two subsequent print jobs, the slow discharge process being a sheet discharge process in which sheet discharging ability of the sheet discharge unit is impaired.

According to aspects of the invention, there is also provided with a printing device, which is provided with a printing unit configured to print an image on a sheet, a sheet discharge unit having a discharge tray and configured to discharge the sheet from the printing unit to the discharge tray at a predetermined discharge speed, and a control unit configured to switch the predetermined discharge speed of the sheet discharge unit between a first speed and a second speed which is slower than the first speed. The control unit is configured to switch the discharge speed of the sheet discharge unit from the first speed to the second speed if printing comes to a last page of a currently executing print job and a predetermined condition is satisfied.

BRIEF DESCRIPTION OF THE ACCOMPANYING DRAWINGS

DETAILED DESCRIPTION

Figure 1:
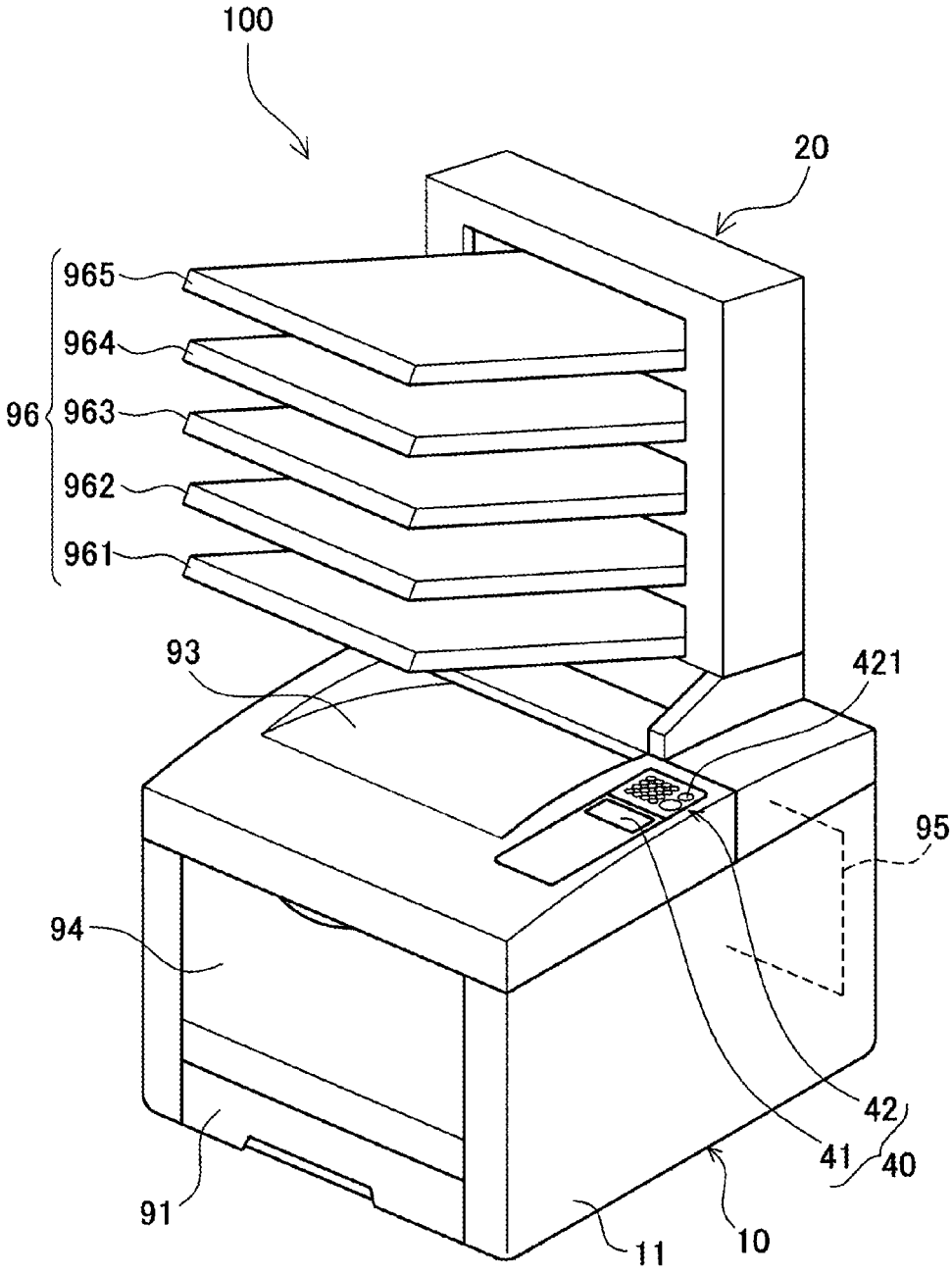
FIG. 1 is a perspective view of a printer according to an embodiment of the invention.

Hereinafter, an exemplary embodiment according to aspects of the present invention will be described with reference to the accompany drawings. Specifically, an electrophotographic printer capable of performing a high-speed printing will be described.

A printer 100 according to an embodiment has a main unit 10 at which images are printed on recording sheets, and an expanded sheet discharge unit 20 provided with a plurality of sheet discharge trays on which printed sheets are discharged. The main unit 10 has a process cartridge serving as a print engine inside a cover 11. The expanded sheet discharge unit 20 is detachably coupled to the main unit 10 on its upper surface.

The main unit 10 has a sheet feed cassette 91 which accommodates unprinted recording sheets. It should be noted that more than one sheet feed cassette 91 may be provided. For example, below the sheet feed cassette 91, an auxiliary sheet feed cassette may be attached. According to the embodiment, the main unit 10 has a sheet discharge tray 93, on which printed sheets are discharged in a face-down manner, is formed on its upper surface.

On a front surface of the main unit 10, a multi-purpose tray 94 is provided. With use of the multi-purpose tray 94, manual feed of recording sheets can be done. The multi-purpose tray 94 is arranged to be openable/closeable with respect to a cover 11 of the main unit 10. Specifically, the multi-purpose tray 94 is rotatable about an axis provided to a lower side portion. When the multi-purpose tray 94 is fully opened, the manual sheet feed can be performed with use of the multi-purpose tray 94. Further, the main unit 10 is provided with a discharge tray 95, on which the printed sheets are stacked in a face-up manner. The sheet discharge tray 95 is also rotatably secured to the cover 11 of the main unit 10, and can be used as the sheet discharge tray 95 when fully opened.

On the upper face of the main unit 10, an operation unit 40 provided with a display unit 41 having an LCD (liquid crystal display) and a button group 42 including an OK button, a cancel button, ten keys, a user authentication button, etc. is provided. In particular, the button group 42 includes a removal button 421 for allowing the user to have an opportunity to pick up the printed sheets from the discharge trays. With use of the operation panel, the user can view an operation status and/or input various commands.

The expanded sheet discharge unit 20 has a five-stage discharge tray group 96. According to the embodiment, the five-stage discharge tray group 96 has discharge trays 961, 962, 963, 964 and 965, from the bottom to top (see FIG. 1). It should be noted that the discharge tray group 96 needs not be limited to the five-stage discharge trays, and the number of stages may be less than or more than five.

The main unit 10 of the printer 100 is provided with a processing unit 50 which forms a toner image in accordance with a well-known electrophotographic imaging method and transfers the toner image on the recording sheets, and a fixing device 8 which fixes the toner images transferred on the recording sheets, and rollers (e.g., a sheet feed roller 71, a register roller 72, a sheet introducing roller 74 and a sheet discharge roller 75).

The expanded discharge unit 20 has discharge rollers 761, 762, 763, 764 and 765 that feed the recording sheet to the discharge trays 961, 962, 963, 964 and 965, respectively.

Figure 2:
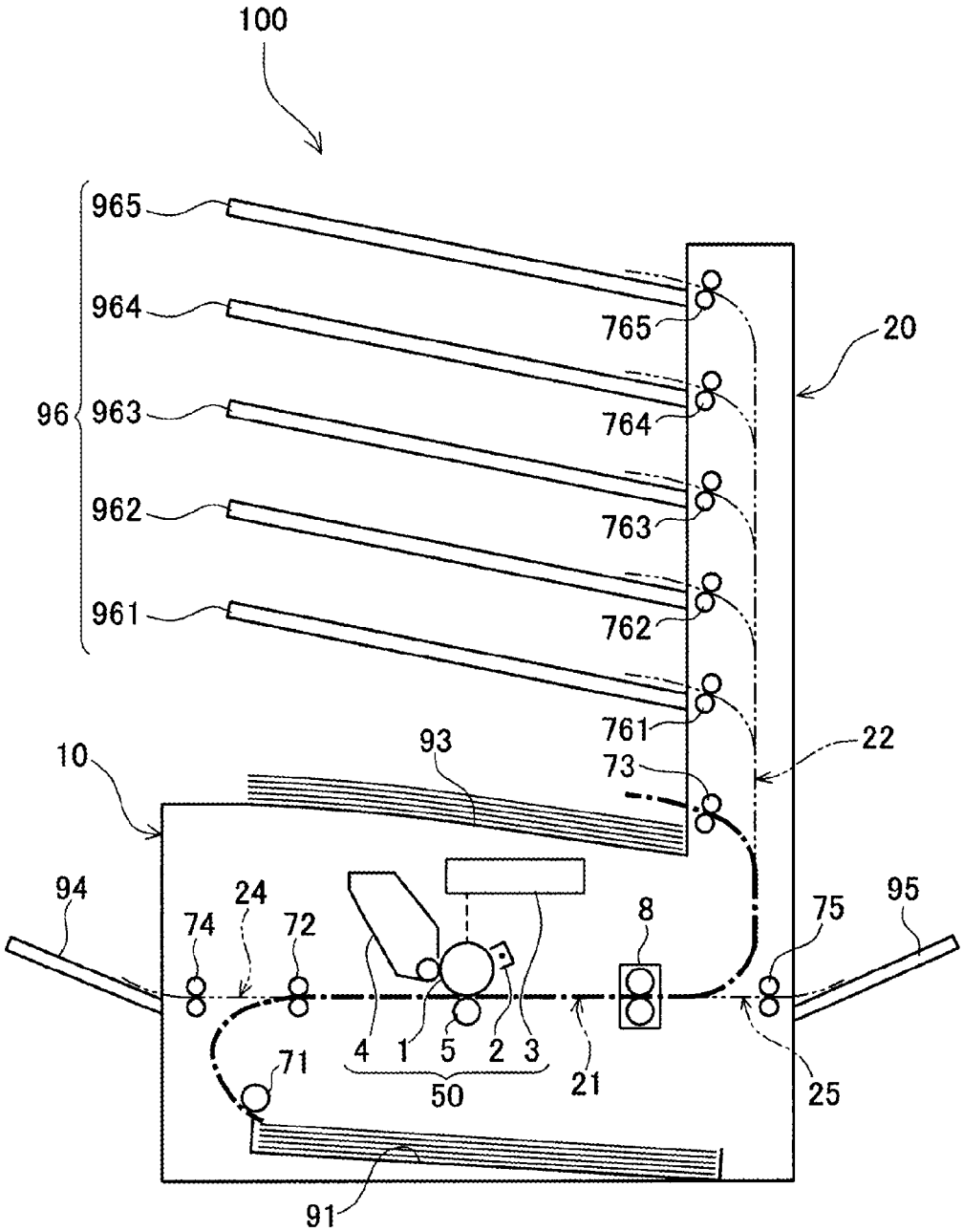
FIG. 2 is a cross-sectional side view schematically showing a mechanical configuration of the printer shown in FIG. 1.

Inside the main unit 10, a substantially S-shaped sheet feed path 21 (which is indicated by dotted lines in FIG. 2) is defined such that the recording sheets accommodated in the sheet feed cassette 91, which is located at the bottom of the main unit 10, are directed to the discharge tray 93 via the sheet feed roller 71, the register roller 72, the processing unit 50, and the fixing unit 8.

In the main unit 10, a substantially linear feeding path 24 is defined so that the recording sheets introduced from the multi-purpose tray 94 is fed to the processing unit 50 via the introducing roller 74. Further, in the main unit 10, a substantially linear feeding path 25 is defined so that the recording sheet passed through the fixing unit 8 is directed to the discharge tray 95 via the discharge roller 75.

Inside the printer 100, a sheet feed path 22 is defined, along which the printed sheets are fed toward the expanded discharge tray unit 20 so that the printed sheets are finally directed to the intended discharge tray. Specifically, the printed sheet fed into the expanded discharge tray unit 20 are directed to the discharge tray 961 via the discharge roller 761, or directed to the discharge tray 962 (963, 964, 965) via the discharge roller 762 (763, 764, 765).

The processing unit 50 is configured to form a toner image in accordance with the well-known electrophotographic imaging process. Specifically, the processing unit 50 includes a charging unit 2 which uniformly charges the circumferential surface of the photoconductive drum 1, an exposing unit 3 which emits scanning light beam, which is modified based on an image to be formed, on the circumferential surface of the photoconductive drum 1 to form an electrostatic latent image, a developing unit 4 which applies toner to the electrostatic latent image to form a toner image, and a transfer unit 5 which transfers the toner image on the photoconductive drum 1 onto the recording sheet. The photoconductive drum 1, the charging unit 2, and the developing unit 4 are accommodated in a process cartridge, which is detachably attached to the main unit 10.

In the processing unit 50, the circumferential surface of the photoconductive drum 1 is uniformly charged by the charging unit 2. Thereafter, the charged surface of the photoconductive drum is exposed to the light beam emitted by the exposing unit 3 and a latent image is formed thereon. Then, by the developing unit 4, toner, which is a coloring agent, is supplied to the photoconductive drum 1. Then, the latent image is developed as the toner image.

The printer 100 picks up the recording sheets mounted on the sheet feed cassette 91 or the fed from the multi-purpose tray 94, one by one, and feeds the recording sheet to the processing unit 50. Then, the toner image formed on the photoconductive drum 1 is transferred onto the recording sheet by the transfer unit 5. The recording sheet bearing the toner image is fed to the fixing unit 8, where the toner image is heated and fixed onto the recording sheet. Then, the recording sheet, on which the toner image is fixed, is discharged on the discharge tray that is designated in the print job.

Figure 3:
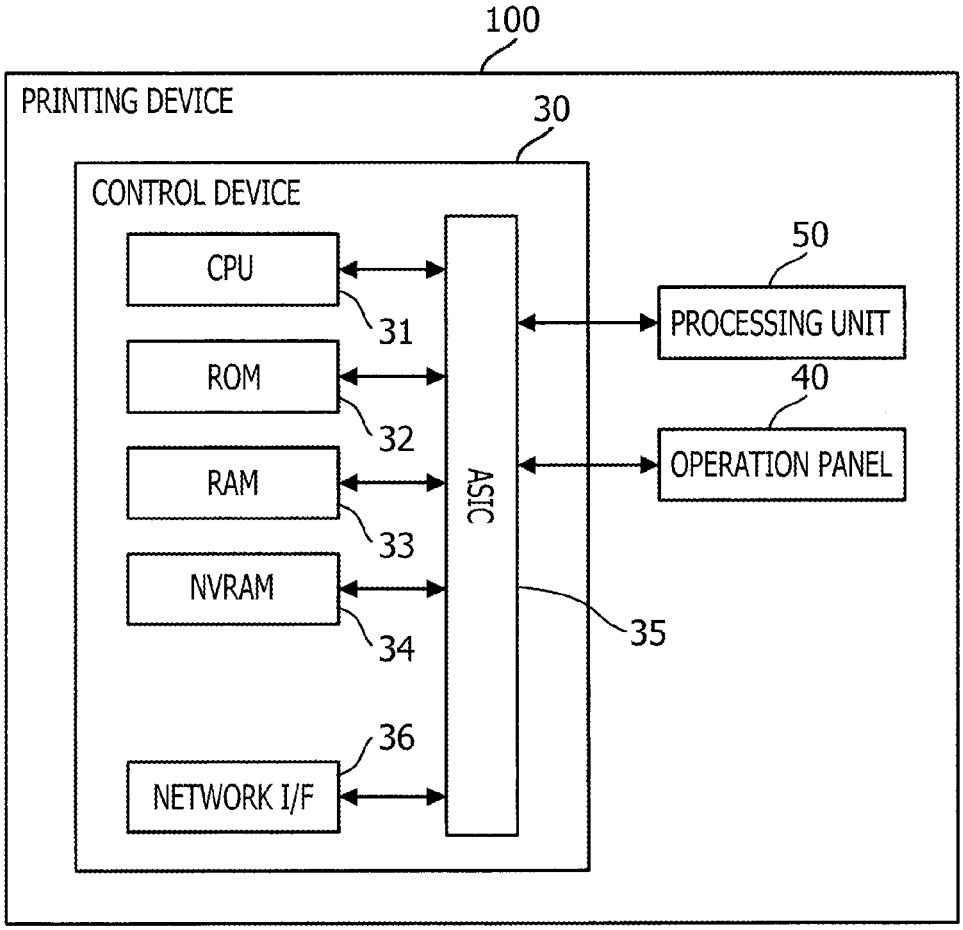
FIG. 3 is a block diagram schematically showing electrical configuration of the printer shown in FIG. 1.

Next, the electrical configuration of the printer 100 will be described. The printer 100 has a control unit 30 which is provided with a CPU 31, a ROM 32, a RAM 33, an NVRAM (non-volatile RAM) 34, an ASIC (application specific integrated circuits) 35, and a network interface 36 (see FIG. 3). The control unit 30 is electrically connected with the processing unit 50, the operation panel 40, the main unit 10, and driving motors for driving the rollers in the expanded discharge unit 20.

The CPU 31 controls the entire operation of the printer 100 by executing various functions including a function of allowing a user to remove printed sheets during the continuous printing, which will be described below. The ROM 32 stores control programs to be executed by the CPU 31 to control the printer 100, and various setting values, initial values and the like. The RAM 33 is used for a working area when the control programs are executed by the CPU 31, and for a temporary storage area for temporarily storing image data. The NVRAM 34 is a non-volatile memory and stores various setting values and/or image data.

The CPU 31 controls each unit via the ASIC 35 in accordance with the control programs and signals transmitted by the sensors, with storing the operational results in the RAM 33 and/or NVRAM 34.

The network interface 36 is connected to a network such as the Internet, and enables information processing devices such as a personal computer (PC) to connect with the network. Through the network interface 36, jobs can be transferred.

Next, the function of allowing a user to remove the printed sheet from the printer 100 will be described. Hereinafter, this function will be referred to as a removal function.

The removal function is activated when the removal button 421 is depressed during a printing operation is being performed. According to the first embodiment, when the removal button 421 is depressed, a sheet discharging performance is impaired at an end of the print job so that the sheet discharging speed is lowered. In the description hereinafter, the term "sheet discharging performance" means the performance from an introduction of a sheet from the sheet tray to the discharge of the same sheet. When the sheet discharge performance is higher, the printed sheets are discharged at a higher pace.

Specifically, when the sheet discharging performance is to be impaired, the sheet feeding speed is lowered, the sheet feed is temporarily paused and/or the sheet feed interval (a time interval between a previous sheet is fed and the subsequent sheet is fed) is elongated. When the sheet discharging performance is impaired, the discharging pace is lowered. When the sheet discharging performance is impaired, it becomes easier for the user to pick up the discharged (and stacked) printed sheets from the discharge tray. In the following description, a discharge process with lowered sheet discharging performance will be referred to as a slow discharge process.

The opportunity for the user to pick up the discharged printed sheets is given when the removal button 421 is depressed.

Figure 4:
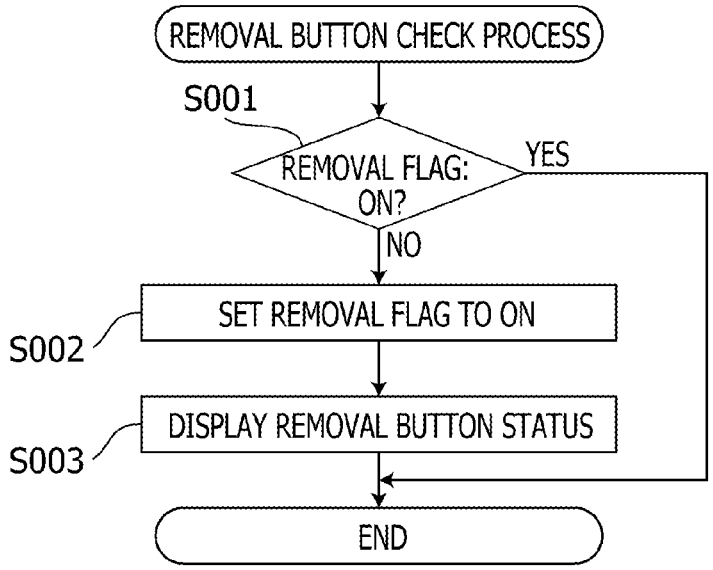
FIG. 4 is a flowchart illustrating a removal button depression process according to a first embodiment of the invention.

As shown in FIG. 4, the CPU 31 judges whether a removal flag indicates that the removal button 421 has been depressed or not (ON: depressed; OFF: not depressed). The removal flag is stored in the RAM 33. When the removal button 421 has been depressed, the removal flag is set to ON, while the removal flag is OFF if the removal button 421 is not being depressed or a print job has been finished. If the removal flag is ON 8 (S001: YES), the CPU 31 finishes the removal button check process (FIG. 4).

Figure 5:
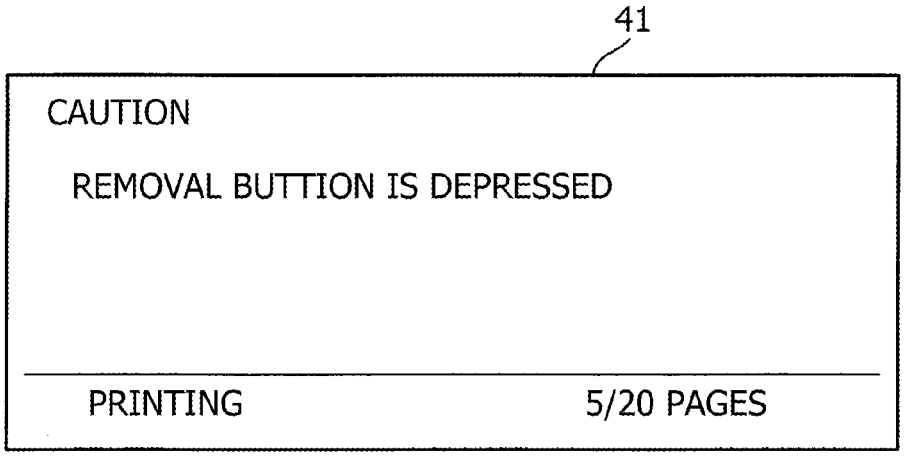
FIG. 5 shows an example of an information window which is displayed when the removal button is depressed, according to the first embodiment of the invention.

If the removal flag is OFF (S001: NO), the CPU 31 sets the removal flag to ON (S002). Then, the CPU 31 displays a message that the removal button 421 has been depressed on the display unit 41 (S003) as shown in FIG. 5. Thereafter, the CPU 31 terminates the removal button check process.

Figure 6:
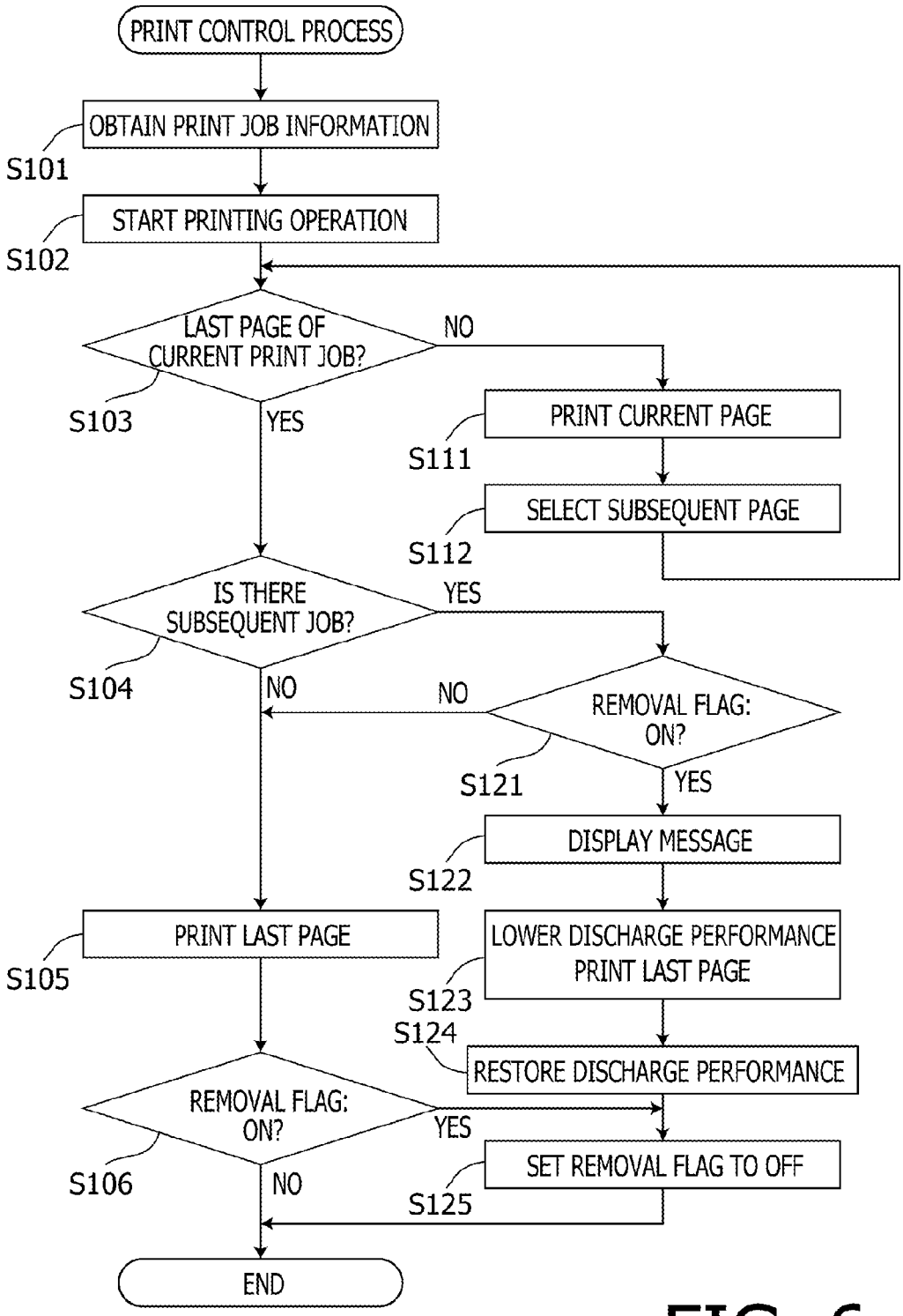
FIG. 6 is a flowchart illustrating a printing process according to the first embodiment of the invention.

FIG. 6 shows a flowchart illustrating a print control process according to the first embodiment. The print control process is executed every time when a print job in a job queue is executed.

In S101, the CPU 31 obtains job information regarding a print job to be executed. The job information contains user information, the number of pages to be printed, a discharge destination, and the like. Next, the CPU 31 starts printing a top page of the print job (S102).

Next, the CPU 31 judges whether the page to be printed is the last page of the current print job (S103). If the currently processed page is not the last page (S103: NO), the currently processed page is printed (S111), and the next page is set to the page subject to be printed (S112). After execution of S112, the CPU 31 returns to S103.

If the currently processed page is the last page of the current print job (S103: YES), the CPU 31 judges whether there is a subsequent print job following the presently executed job in the job queue (S104). If there is no subsequent print job in the job queue, the printing operation will be finished after printing the last page of the currently executed print job. In such a case, the slow discharge process does not need to be executed. Therefore, if there is no subsequent job in the job queue (S104: NO), the CPU 31 prints out the last page (S105) without executing the slow discharge process. Thereafter, the CPU 31 judges whether the removal flag is ON (S106). If the removal flag is OFF (S106: NO), the CPU 31 terminates the print control process. If the removal flag is ON (S106: YES), the CPU 31 sets the removal flag to OFF (S125) and terminates the print control process.

If there is a subsequent job in the job queue (S104: YES), the CPU 31 judges whether the removal flag is ON, that is, whether the removal button 421 has been depressed (S121). If the removal flag is OFF (S121: NO), it is not necessary to execute the slow discharge process in steps S122 onwards. Therefore, in such a case, the CPU 31 moves to S105 and prints out the last page.

Figure 7:
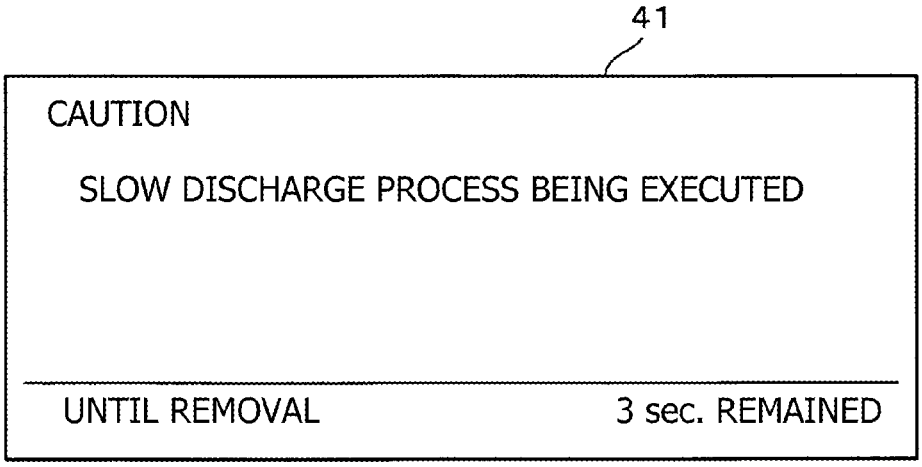
FIG. 7 shows an example of an information window which is displayed when a slow discharge process according to the first embodiment of the invention is executed.

If the removal flag is ON (S121: YES), the CPU 31 moves to S122 and prepares for the slow discharge process. When the slow discharge process is executed, the CPU 31 displays a message as shown in FIG. 7 on the display unit 41 (S122). If the performance of the discharge operation is impaired without any messages, the user may have anxiety. Therefore, according to the first embodiment, by displaying the message informing the user of the slow discharge process, such anxiety can be reduced.

Thereafter, the CPU 31 prints out the last page with executing the slow discharge process (i.e., a process of impairing the discharging performance) in S123. An example of the slow discharge process is to execute the printing operation of the last page at a slower speed (when the image formation speed is decreased). Another example may be reduction of the sheet feed speed, elongate a sheet distance between two subsequently fed sheets (when the sheet feed speed is decreased). Another example may be temporary interruption of the sheet feed operation after completion of printing on the last page and/or discharge of the last page (when the temporary interruption is made). It is of course possible to employ reduction of the sheet feed speed and temporary interruption of the sheet feed operation as the slow discharge process.

Next, the CPU 31 cancels (i.e., stops executing) the slow discharge process and restores the discharging performance (S124). For example, when the sheet feed speed is reduced, the sheet feed speed is changed to the speed before it is reduced after the last page is printed out. If the sheet feed operation is temporarily paused, the sheet feed operation is restarted on condition that a predetermined period has elapsed after the sheet feed operation was stopped. When the discharge performance is restored, the removal flag is set to OFF (S125). After S125, the CPU 31 terminates the print control process.

As described above, according to the first embodiment, the slow discharge process is executed on condition that the user depresses the removal button 421. Further, it should be noted that, according to the first embodiment, even if the removal button 421 is depressed, the slow discharge process is not executed before the printing operation of the last page of the currently executed print job is started. With the above configuration, when the slow discharge process is executed and user removes the discharged printed sheets, all the printed sheets of the print job can be removed.

Next, a print control process according to a second embodiment will be described. According to the second embodiment, the printer 100 judges whether the slow discharge process is necessary or not.

Figure 8:
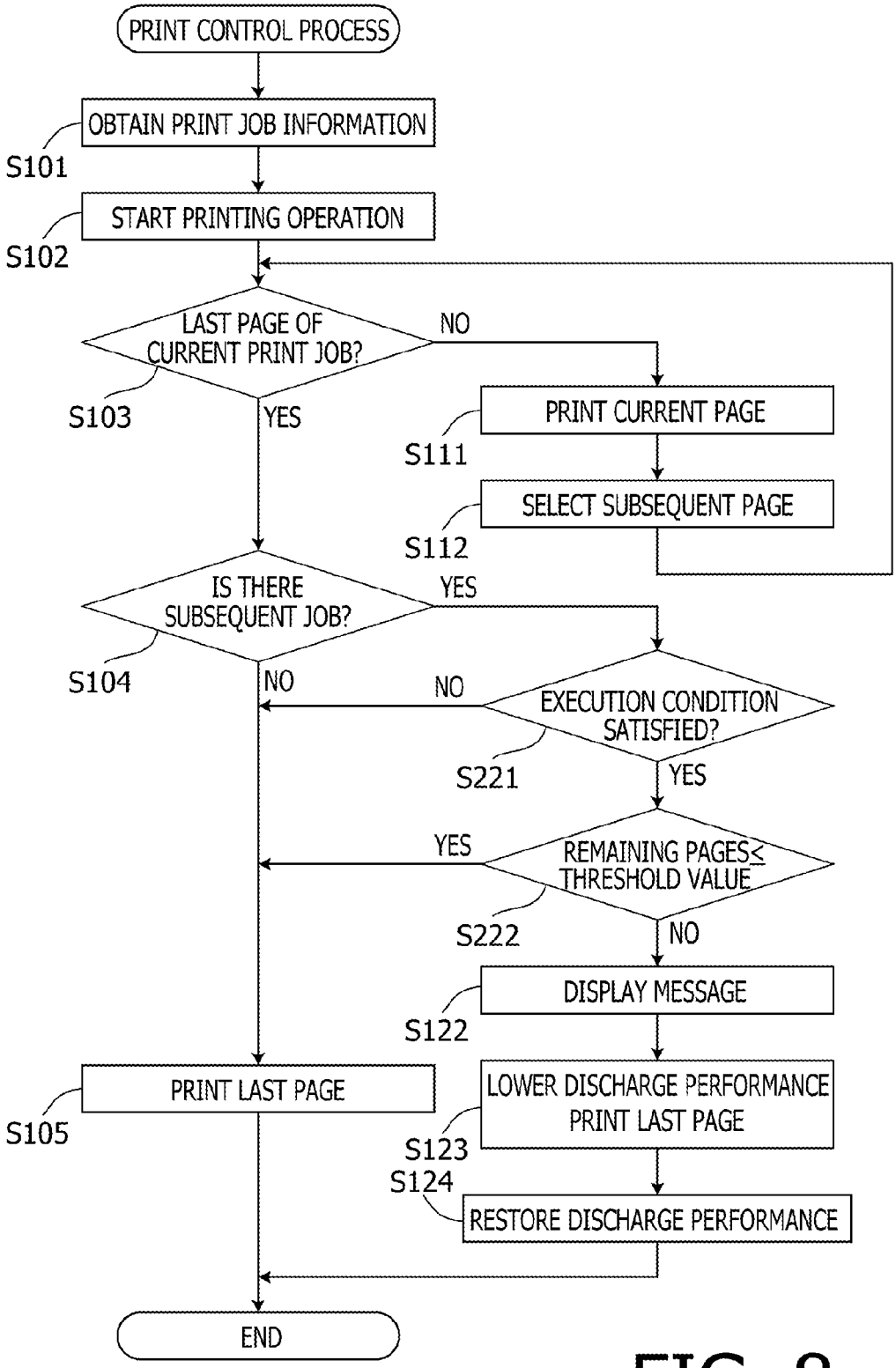
FIG. 8 shows a flowchart illustrating the print control process according to a second embodiment of the invention.

The print control process (see FIG. 8) according to the second embodiment is executed when each print job in the job queue is executed similarly to the print control process according to the first embodiment. In FIG. 8 and following description, the steps similar to those in the first embodiment are indicated by the same step numbers and detailed description will not be given for brevity. The print control process according to the second embodiment is particularly different from that of the first embodiment when the page subject to be printed is the last page (S103: YES).

According to the second embodiment, if the current page subjected to be printed is the last page of the current print job (S103: YES), the CPU 31 judges whether there is a subsequent print job in the print queue (S104). If there is no subsequent print job (S104: NO), it is unnecessary to execute the slow discharge process. Therefore, the CPU 31 prints out the last page (S105) and finishes the currently executed print job.

If there is a subsequent job in the job queue (S104: YES), the CPU 31 judges whether a execution condition to start the slow discharge process is satisfied (S221). According to the second embodiment, the printer 100 stores at least one execution condition in the ROM 32.

An example of the "execution condition" is a "high-speed printing." That is, according to the second embodiment, the printer 100 is configured to operate in the high-speed mode or a low-speed mode. The mode to be used is determined based on a type of the sheets and resolution. For example, when the printing operation is executed using thick sheets, the mode to be used is a slow printing mode since it takes a longer period for fixing when the thick sheets are used. For another example, when the printing operation is executed at a resolution higher than a standard resolution, the mode to be used is the slow printing mode. If the execution condition is not the above conditions, the mode to be used is a high speed printing mode. Incidentally, when the printing operation is executed in the slow printing mode, the problem that the user has a difficulty in removing the printed sheets would not occur since the sheet feeding speed is low. Therefore, according to the second embodiment, when the printing operation is executed at the high speed print mode, it is judged that the condition is satisfied.

Another example is, for example, the user of the currently executed print job and the user of a subsequent print job are different. In such a case, the condition is considered to be met. If the user of the preceding print job and the user of the subsequent print job are the same, it is very likely that the user removes the printed sheets of both print jobs and may not remove the printed sheets at the end of each print job. Thus, in view of productivity, only when the user of the previous job and the user of the subsequent print job are different, the execution condition is considered to be met.

Another example is a case where the currently executed print job and the subsequent print job use the same discharge tray. If the previous print job and the subsequent print job use different discharge trays, it would not be difficult for the user to remove the printed sheets although the slow discharge process is not executed. Thus, in view of productivity, it is judged that the execution condition is met if the previous print job and the subsequent print job use the same discharge tray.

Another example is a case where the currently executed print job is a secure print job, while the subsequent print job is a non-secure print job. The "secure print job" is a print job that requires the user's input of a password. It is very likely that the user of the secure print job removes the printed sheet immediately after the secure print job is finished. Therefore, when the secure print job is executed, it is likely that the slow discharge process is required. If the subsequent print job is the secure print job, the user is required to input the password before the subsequent print job is started. Therefore, in such a case, the user have a chance to remove the printed sheets of the previous print job (regardless whether the previous print job is the secure print job or non-secure print job) since the subsequent print job is not executed until the user inputs the password. Therefore, the execution condition is considered to be met when the currently executed job is the secure print job and the subsequent print job is the non-secure print job.

The printer 100 stores at least one of the execution conditions as described above, and judges whether the execution condition is met (S221). It should be noted that the execution condition need not be limited to one, but a plurality of execution conditions are stored, and two or more execution conditions may be combined. If the print job does not meet the execution condition (S221: NO), the slow discharge process is not necessary and the CPU 31 proceeds to S105 to print the last page. If the execution condition is satisfied (S221: YES), the CPU 31 calculates the total number of sheets to be used in all the following print jobs in the job queue (hereinafter, referred to as the number of remaining pages), and judges whether the number of remaining pages is equal to or less than a threshold value (S222). If the number of remaining pages is equal to or less than the threshold value (S222: YES), it is expected that the printing operation will be finished within a relatively short period. If so, even if the user is required to wait until all the print jobs are completed, the user may not complain. Therefore, if the number of remaining pages is equal to or less than the threshold value (S222: YES), even if the execution condition is satisfied, the slow discharge process is not started, and the print control process is finished when the last page is printed (S105).

If the number of remaining pages is greater than the threshold (S222: NO), the CPU 31 displays a message indicating that the slow discharge process is being executed on the display unit 41 (S122). Then, the CPU 31 prints the last page with executing the slow discharge process (S123). Thereafter, the CPU 31 restores the discharge function so that the discharge is executed at a normal speed (S124) and the CPU 31 terminates the print control process.

According to the second embodiment, the slow discharge process is started when the predetermined execution condition is satisfied. Further, whether the predetermined condition is satisfied or not is determined when the last page of the print job is being executed. Until then, the slow discharge process is not executed. When the last page is printed, whether the execution condition is satisfied or not is judged, and when necessary, the slow discharge process is executed. With this configuration, the user can remove all the printed sheets of the print job when the slow discharge process is executed.

Next, a printing device according to the third embodiment will be described. According to the third embodiment, the slow discharge process is always executed between two subsequent print jobs.

Figure 9:
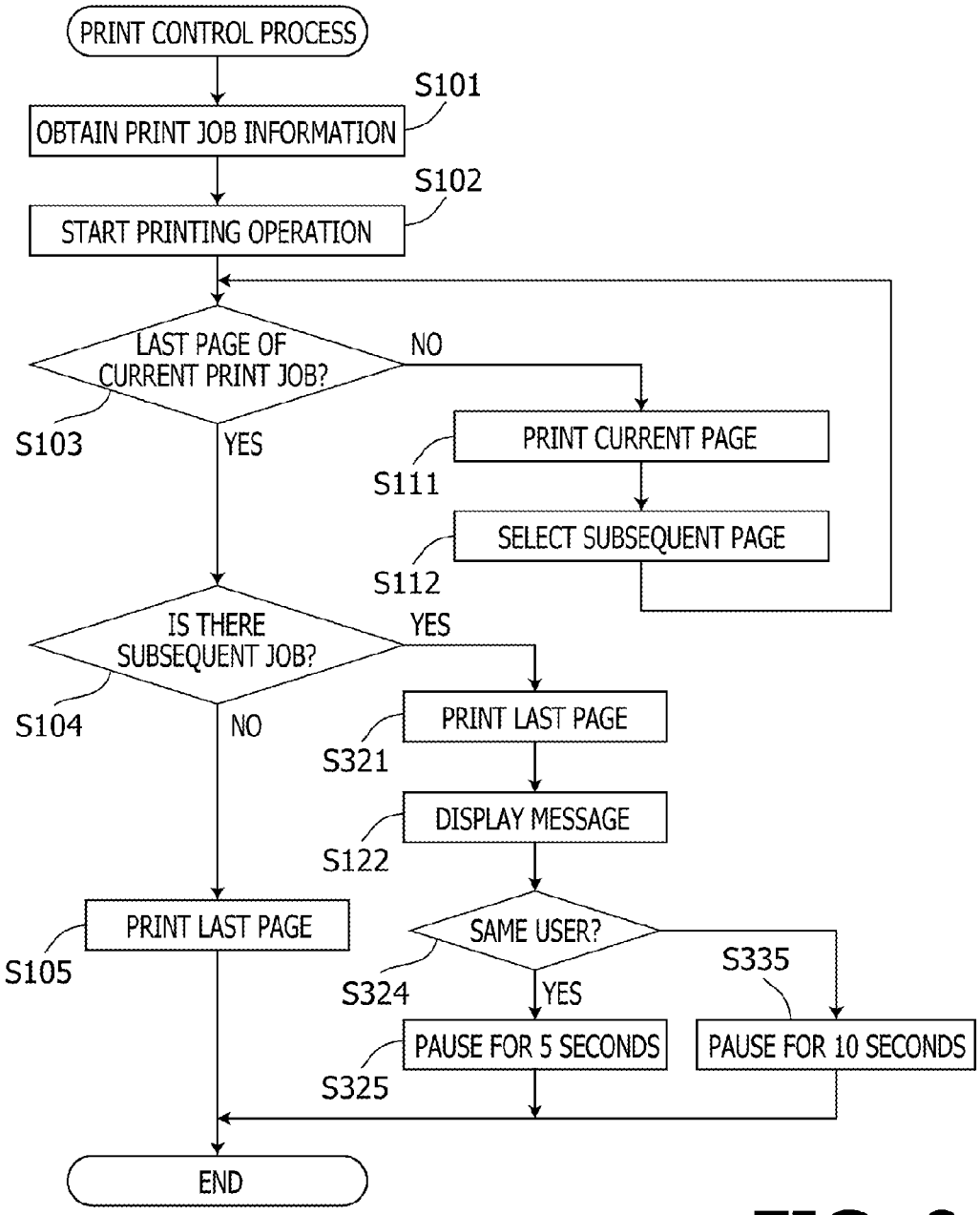
FIG. 9 shows a flowchart illustrating the print control process according to a third embodiment of the invention.

A print control process according to the third embodiment (FIG. 9) is executed by the CPU 31 when each of the print jobs in the job queue is executed, similarly to the first embodiment. In the following description, to steps same as those in the first embodiment, the same step numbers are given and detailed description thereof will be omitted. According to the third embodiment, if a page to be printed is the last page (S103: YES), the following steps are different from those of the first embodiment.

According to the third embodiment, when the page to be printed is the last page (S103: YES), the CPU 31 judges whether there is a subsequent print job (S104). If there is no subsequent print job in the job queue (S104: NO), it is not necessary to execute the slow discharge process. Therefore, in that case, the CPU 31 simply prints out the last page (S105) and finishes the print control process.

If there is a subsequent print job in the job queue (S104: YES), the CPU 31 prints out the last page (S321) and displays a message indicating that the slow discharge process is being executed on the display unit 41 (S122).

Next, the CPU 31 judges whether the user of the currently executed print job and the user of the subsequent print job are the same (S234). If the users are the same (S324: YES), the CPU 31 pauses for five seconds before starting the printing operation for the subsequent print job (S325). If the users are different (S324: NO), the CPU 31 pauses for ten seconds before starting the printing operation for the subsequent print job (S335).

When the two subsequent print jobs are of the same user, the possibility that the user removes the printed sheets between the two subsequent print jobs is low. If the two subsequent print jobs are of the different users, the possibility that the user of the previous print job removes the printed sheets before the subsequent print job is started is high. Therefore, the pausing period between the previous print job and the subsequent print job is shorter if the users are the same, while the pausing period is longer when the users of the two subsequent print jobs are different.

According to the third embodiment, the slow discharge process is always executed if there are two subsequent print jobs, and the slow discharging is applied to the last page of the preceding print job. With this configuration and since the slow discharge process is not executed until the last page is printed, when the user removes the printed sheets, the user can removes all the printed sheets for the print job.

As described above, according to the embodiments, as the slow discharge process is executed, the sheet discharging pace is lowered so that user can remove the printed sheets easily. Further, the slow discharge process is executed between the previous print job and the subsequent print job. With this configuration, when the slow discharge process is executed and the user picks up the printed sheets, the printed sheets include all the pages of the previous print job. Therefore, it is unnecessary for the user to pick up the printed sheets repeatedly to collect all the pages. Further, the printed sheets for one print job will not be distributed to a plurality of sheet trays, and thus, the user can collect the printed sheets easily.

The above-described embodiments are only exemplary ones and the invention should not be limited to such exemplary embodiments. The printing device according to the invention can be modified in various ways without departing from the scope of the invention. For example, the invention can be applied not only to the printer but to devices such as a copier, a multi-function device, a facsimile device and the like, which have a printing function. In the embodiment, the electrophotographic image formation method is employed. However, the image formation method need not be limited to the electrophotographic image formation method but any other method, for example, an inkjet printing method, can be employed.

According to the first embodiment, the slow discharge process is executed in response to the user's input, and according to the second embodiment, the slow discharge process is executed based on the judgment by the CPU of the printer. The above embodiments may be combined. That is, the slow discharge process may be executed when (1) the user inputs an execution instruction (e.g., depression of a button) and (2) a predetermined execution condition is satisfied. Alternatively, the slow discharge process may be executed when the user inputs an execution instruction, or a predetermined execution condition is satisfied. Further alternatively, the slow discharge process may be executed when the user inputs an execution instruction but may not be executed if the remaining pages are equal to or less than a threshold value.

Optionally, the control of the third embodiment may be combined with the control of the first or second embodiment. For example, the slow discharge process may be executed in response to the user's input or when the execution condition is satisfied, and in such a case, the pausing period between the subsequent print jobs may be varied depending on whether the users of the two subsequent print jobs are the same or different.

In the embodiments, when the slow discharge process is executed, the slow discharging operation is applied only to the last page of the currently executed print job. However, the invention need not be limited to such a configuration. For example, the slow discharging operation may be applied to a predetermined number of subsequent pages including the last page.

According to the embodiment, when the slow discharge process is executed, the slow discharging operation is applied to the last page of the current print job. However, the invention need not be limited to such a configuration. For example, the slow discharging operation may be applied to only the first page of the subsequent print job, or applied to both the last page of the current print job and the first page of the subsequent print job.

According to the first embodiment, the slow discharge process is started when the user depresses the removal button 421. The invention need not be limited to such a configuration. For example, the slow discharge process may be started when presence of a user about the printer is detected, for example, with use of a human sensor, a user authentication, and the like.

In the second embodiment, the printer 100 has an expanded discharge tray unit 20, which has a plurality of discharge trays. It should be noted that the invention can be applied to a printer which has a single discharge tray. In such a case, in the second embodiment, it is unnecessary to take the other discharge trays when an execution condition is checked.

According to the third embodiment, when the operation is paused as the slow discharge process is executed, the operation is restored after elapse of a predetermined period. In other words, the paused status is cancelled when a certain condition (i.e., elapse of the predetermined period) is satisfied. The cancellation condition need not be limited to the condition of the time period. For example, a cancellation button may be provided and the paused status may be cancelled in response to the user's operation of the cancellation button. For another example, a weight sensor may be provided to each discharge tray, and the paused status may be cancelled if removal of the sheets on the destination discharge tray is detected.

What is claimed:

1. A printing device comprising:

a printing unit configured to execute:

a first print job of printing on one or more sheets, and a second print job subsequent to the first print job of printing on one or more sheets;

a sheet discharge unit comprising a discharge tray, wherein the sheet discharge unit is configured to discharge the one or more sheets printed in the first print job and the one or more sheets printed in the second print job from the printing unit to the discharge tray;

a judging unit configured to judge whether a predetermined condition is satisfied before completion of the first print job, wherein the predetermined condition includes a condition that the number of sheets to be printed in the second print job which is to be executed exceeds a predetermined number; and a control unit configured to control the sheet discharge unit to execute a slow discharge process based on the judging unit judging that the predetermined condition is satisfied, and to disable the slow discharge process based on the judging unit judging that the predetermined condition is not satisfied, wherein the slow discharge process is applied to a last part of the first print job, wherein the slow discharge process includes slowing the discharge speed of at least the last page of the first print job, and wherein to slow the discharge speed does not include to stop discharging a sheet.

2. The printing device according to claim 1, further comprising a detection unit configured to detect an instruction to execute the slow discharge process, wherein the control unit executes the slow discharge process when the detection unit detects the instruction to execute the slow discharge process.

3. The printing device according to claim 1, wherein the sheet discharge unit includes a plurality of the discharge tray, and wherein the predetermined condition further includes a condition that the one or more sheets to be printed in the first print job and the one or more sheets to be printed in the second print job are discharged by the sheet discharge unit to the same discharge tray of the plurality of discharge trays.

4. The printing device according to claim 1, wherein the predetermined condition further includes a condition that a user of the first print job is different from a user of the second print job.

5. The printing device according to claim 1, wherein the printing unit is configured to operate in a high-speed print mode and a low-speed print mode, and wherein the predetermined condition further includes a condition that the first print job is executed in the high-speed print mode.

6. The printing device according to claim 1, wherein the predetermined condition further includes a condition that a sheet to be printed by the printing unit in the first print job is the last sheet of the first print job.

7. The printing device according to claim 1, further comprising a notification unit configured to notify a user of execution of the slow discharge process in response to startup of the slow discharge process.

8. The printing device according to claim 1, wherein the control unit is configured to cancel the slow discharge process if a cancellation condition is satisfied.

9. The printing device according to claim 8, wherein the cancellation condition includes elapse of a predetermined time period after start of the slow discharge process.

10. The printing device according to claim 1, wherein the sheet discharge unit further comprises a discharge roller configured to feed the one or more sheets printed by the first print job and the one or more sheets printed by the second print job towards the discharge tray from the printing unit, and wherein the slow discharge process includes at least one of:

a process of controlling the discharge roller to pause sheet feeding; and a process of controlling the discharge roller to increase an interval between two sequentially printed sheets.

11. A printing device comprising:

a printing unit configured to execute:

a first print job of printing on one or more sheets, and a second print job subsequent to the first print job of printing on one or more sheets;

a sheet discharge unit comprising a discharge tray, wherein the sheet discharge unit is configured to discharge the one or more sheets printed in the first print job from the printing unit to the discharge tray at one of a first discharge speed and a second discharge speed that is slower than the first discharge speed and faster than zero; and a control unit configured to:

control the printing unit to begin executing the first print job and control the sheet discharge unit to begin discharging the one or more sheets printed in the first print job to the discharge tray at the first discharge speed, determine whether a sheet to be printed by the printing unit as part of the first print job is the last sheet of the first print job, determine whether a predetermined condition is satisfied before completion of the first print job, wherein the predetermined condition includes a condition that the number of sheets to be printed in the second print job which is to be executed exceeds a predetermined number, control the sheet discharge unit to discharge the last sheet of the first print job to the discharge tray at the second discharge speed based on the control unit determining that the sheet to be printed by the printing unit as part of the first print job is the last sheet of the first print job and determining that the predetermined condition is satisfied, control the sheet discharge unit to discharge the last sheet of the first print job to the discharge tray at the first discharge speed based on the control unit determining that the sheet to be printed by the printing unit as part of the first print job is the last sheet of the first print job and determining that the predetermined condition is not satisfied, and control the printing unit to begin executing the second print job.

12. The printing device according to claim 11, further comprising a detection unit configured to detect an externally inputted instruction, wherein the control unit determines that the predetermined condition is satisfied when the detection unit detects the externally inputted instruction and switches the sheet discharge speed from the first speed to the second speed.

13. The printing device according to claim 11, wherein the sheet discharge unit further comprises a plurality of the discharge tray, and wherein the predetermined condition further includes a condition that the first print job and the second print job use the same discharge tray of the plurality of the discharge tray.

14. The printing device according to claim 11, wherein the predetermined condition further includes a condition that a user of the first print job is different from a user of the second print job.

15. The printing device according to claim 11, further comprising a notification unit configured to notify that the sheet discharge speed has been changed from the first discharge speed to the second discharge speed.

* * * * *